US010226943B2

(12) United States Patent
Kondo et al.

(10) Patent No.: US 10,226,943 B2
(45) Date of Patent: Mar. 12, 2019

(54) PRINTING APPARATUS

(71) Applicant: Brother Kogyo Kabushiki Kaisha, Nagoya-shi, Aichi-ken (JP)

(72) Inventors: Tomohiro Kondo, Nagoya (JP); Yasuhiro Torii, Chiryu (JP); Kohei Terada, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/716,605

(22) Filed: Sep. 27, 2017

(65) Prior Publication Data

US 2018/0281453 A1 Oct. 4, 2018

(30) Foreign Application Priority Data

Mar. 30, 2017 (JP) ..... 2017-067079

(51) Int. Cl.
*B41J 2/365* (2006.01)
*B41J 31/10* (2006.01)
*B41J 35/04* (2006.01)

(52) U.S. Cl.
CPC ..... *B41J 2/365* (2013.01); *B41J 31/10* (2013.01); *B41J 35/04* (2013.01); *B41J 2202/30* (2013.01)

(58) Field of Classification Search
CPC . B41J 2/365; B41J 2/375; B41J 2/3558; B41J 2/335
See application file for complete search history.

(56) References Cited

U.S. PATENT DOCUMENTS 4,831,387 A * 5/1989 Sakaguchi ..... B41J 29/36 347/179
5,874,982 A * 2/1999 Ueda ..... B41J 2/365 347/194

FOREIGN PATENT DOCUMENTS

| | | | | |
|---|---|---|---|---|
| JP | S62-053168 U | | 4/1987 | |
| JP | S63-098474 A | | 4/1988 | |
| JP | H06-143747 A | | 5/1994 | |
| JP | 2001-315374 A | | 11/2001 | |
| JP | 2003-103844 A | | 4/2003 | |
| JP | 2008-284695 | * | 11/2008 | B41J 2/365 |
| JP | 2010-143059 | * | 7/2010 | B41J 2/365 |

* cited by examiner

*Primary Examiner* — Huan H Tran
(74) *Attorney, Agent, or Firm* — Banner & Witcoff, Ltd.

(57) ABSTRACT

A printing apparatus includes: a main body; a cassette including a cassette case and a printing medium accommodated in the cassette case; an installing portion provided on the main body for installing the cassette detachably; a thermal head arranged on a substrate provided in the installing portion and having heating elements arranged along a predetermined arrangement direction; a conveyor which conveys the printing medium of the cassette installed in the installing portion along a conveyance path orthogonal to the arrangement direction; a first temperature sensor provided, in the installing portion, on a side of the thermal head with respect to the conveyance path; a second temperature sensor provided in the interior of the cassette case or the installing portion; and a processor which corrects an amount of applying energy to be applied to the heating elements, based on first and second temperatures detected by the first and second temperature sensors.

6 Claims, 8 Drawing Sheets

PRINTING APPARATUS

CROSS REFERENCE TO RELATED APPLICATION

The present application claims priority from Japanese Patent Application No. 2017-067079, filed on Mar. 30, 2017, the disclosure of which is incorporated herein by reference in its entirety.

BACKGROUND

Field of the Invention

The present invention relates to a printing apparatus.

Description of the Related Art

A printing apparatus, which carries out printing by using a cassette accommodating printing media, has been known. For example, a printer described in Japanese Patent Application Laid-open No. H6-143747, carries out printing by applying energy to a heating element of a thermal head, and by heating a printing medium drawn from the cassette with the heating element. In a printing apparatus of this type, in a case where an amount of energy (hereinafter, referred to as "applying energy") to be applied to the heating element is excessively small, there is a possibility that characters printed are faint and patchy. In a case where the amount of applying energy is excessively large, there is a possibility that the characters printed are blurred. In such manner, in a case where the amount of applying energy is inappropriate, there is a possibility that there arises a printing defect.

It has been known that when temperature of a printing medium which is heated by the heating element at the time of printing is identified, it is possible to improve an accuracy of correction of an amount of energy to be applied. The printing medium is conveyed during printing, and there is a possibility that the printing medium is scratched during conveyance. Therefore, practically it is difficult to detect directly the temperature of the printing medium. In the printer in Japanese Patent Application Laid-open No. H6-143747, a thermosensitive resistor is provided on a carriage. When a ribbon cassette is installed on the carriage, the thermosensitive resistor enters into the ribbon cassette. The thermosensitive resistor detects temperature of an interior of the ribbon cassette instead of temperature of the ink ribbon as a printing medium. The printer corrects an amount of energy to be applied on the basis of the temperature at an interior of the ribbon cassette.

SUMMARY

In the printer described above, an improvement is desired in accuracy of correction of the amount of applying energy. It has been known that when the temperature of the heating element is identified, it is possible to improve the accuracy of correction of the amount of the applying energy. Practically, in a case of detecting the temperature of the heating element, since it is necessary to provide the heating element and a temperature sensor integrally, a manufacturing cost is high.

An object of the present teaching is to provide a printing apparatus which is capable of correcting with high accuracy, the amount of energy to be applied.

According to an aspect of the present teaching, there is provided a printing apparatus including a main body in a box shape;

a cassette including a cassette case in a box shape and a printing medium accommodated in the cassette case;

an installing portion provided on the main body, the cassette being detachably installed in the installing portion;

a thermal head arranged on a substrate provided in the installing portion, the thermal head having heating elements arranged along a predetermined arrangement direction;

a conveyor configured to convey the printing medium of the cassette installed in the installing portion along a conveyance path orthogonal to the arrangement direction;

a first temperature sensor provided, in the installing portion, on a side of the thermal head with respect to the conveyance path;

a second temperature sensor provided in any one of the interior of the cassette case and the installing portion; and a processor configured to:

correct an amount of applying energy to be applied to the heating elements, based on a first temperature detected by the first temperature sensor and a second temperature detected by the second temperature sensor; and apply corrected amount of the applying energy selectively to the heating elements to cause the heating elements to generate heat, and carry out printing by heating the printing medium with the heat generated, wherein the cassette case includes a head insertion wall portion, the head insertion wall portion forms a head insertion opening which penetrates the cassette case in a direction in which the cassette is installed in the installing portion, the substrate is inserted in the head insertion opening in an installed state in which the cassette is installed in the installing portion, and in the installed state, the first temperature sensor is arranged inside the head insertion opening and the second temperature sensor is arranged inside the cassette case.

In the printing apparatus according to the aspect of the present teaching, the amount of applying energy is corrected on the basis of the first temperature and the second temperature. In the installed state, since the first temperature sensor is arranged inside the head insertion opening, an effect of heat on the first temperature sensor from the thermal head becomes substantial. Therefore, deviation between change in the first temperature and change in the second temperature becomes small. Moreover, in the installed state, since the second temperature sensor is arranged at the interior of the cassette case, an effect of heat on the second temperature sensor from the thermal head becomes small. Therefore, deviation between change in the second temperature and change in the temperature of the medium becomes small. Accordingly, the printing apparatus is capable of correcting the amount of applying energy with high accuracy.

DESCRIPTION OF THE EMBODIMENTS

Figure 1:
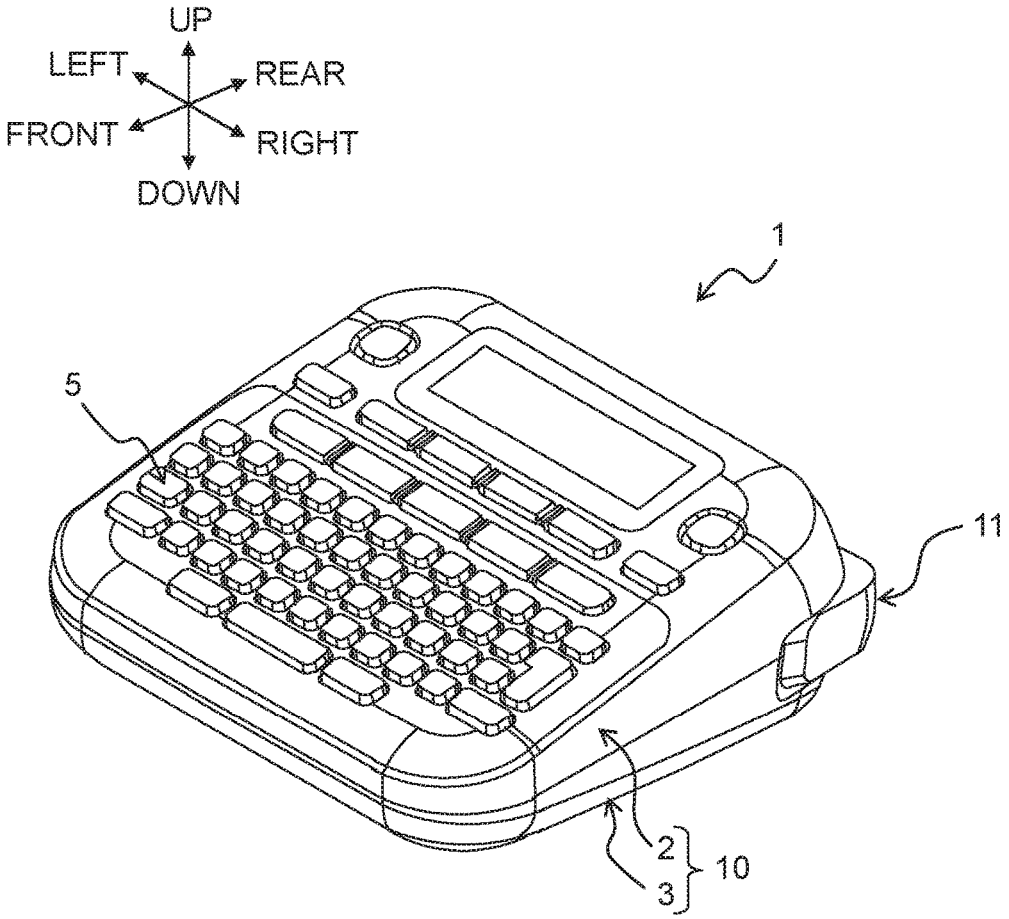
FIG. 1 is a perspective view of a printing apparatus.

An embodiment of the present teaching will be described below by referring to the accompanying diagrams. A lower right side, an upper left side, an upper right side, a lower left side, an upper side, and a lower side in FIG. 1 will be defined as a right side, a left side, a rear side, a front side, an upper side, and a lower side respectively of a printing apparatus 1 and a tape cassette 30.

A mechanical arrangement of the printing apparatus 1 and the tape cassette 30 will be described below by referring to FIG. 1 to FIG. 3. In FIG. 3, for making the arrangement easily understandable, a lower-wall portion of a cassette case 31 is removed (similar in FIG. 6 as well). It is possible to use tape cassettes of various types (such as a thermal type, a receptor type, a laminate type, and a tube type) in one printing apparatus 1. In the following description, various types of long printing media (such as a thermal paper tape 71, a printing tape 91, a two-sided adhesive tape, a tube tape, and a film tape) will be collectively referred to as "tape". The printing apparatus 1 is connectable to an external terminal (omitted in the diagram) via a cable (omitted in the diagram). The printing apparatus 1 prints alphabets and characters such as figures (graphic characters) on a tape on the basis of print data transmitted from the external terminal for example. The external terminal is a personal computer (PC) for example.

As depicted in FIG. 1, the printing apparatus 1 includes a main body 10. The main body 10 is rectangular-parallelepiped box-shaped. The main body 10 includes a first cover 2 and a second cover 3. The first cover 2 is substantially rectangular-parallelepiped shaped. An input section 5 is provided to an upper surface of the first cover 2. The input section 5 includes switches for inputting various information to the printing apparatus 1, and includes a power-supply switch which starts-up the printing apparatus 1.

The second cover 3 is in the form of a plate, and is openable and closable with respect to the first cover 2 with a lower end portion of a front surface of the first cover 2 as an axis. When the second cover 3 is in a state of being closed with respect to the first cover 2 (hereinafter, referred to as "closed state"), the second cover 3 covers an installing portion 7 that will be described later (refer to FIG. 2) from a lower side. When the second cover 3 is in a state of being opened with respect to the first cover 2 (hereinafter, referred to as "open state"), the installing portion 7 is open to the lower side (omitted in the diagram). A discharge port 26 (refer to FIG. 2) is provided near a right-end portion of a rear surface of the first cover 2. The discharge port 26 is an opening extended in a vertical direction. The discharge port 26 discharges the tape subjected to printing at an interior of the printing apparatus 1, to the outside of the printing apparatus 1. An operating portion 11 is provided to a right side of the discharge port 26. A user, by pressing the operating portion 11, operates a cutting mechanism 21 (refer to FIG. 2).

Figure 2:
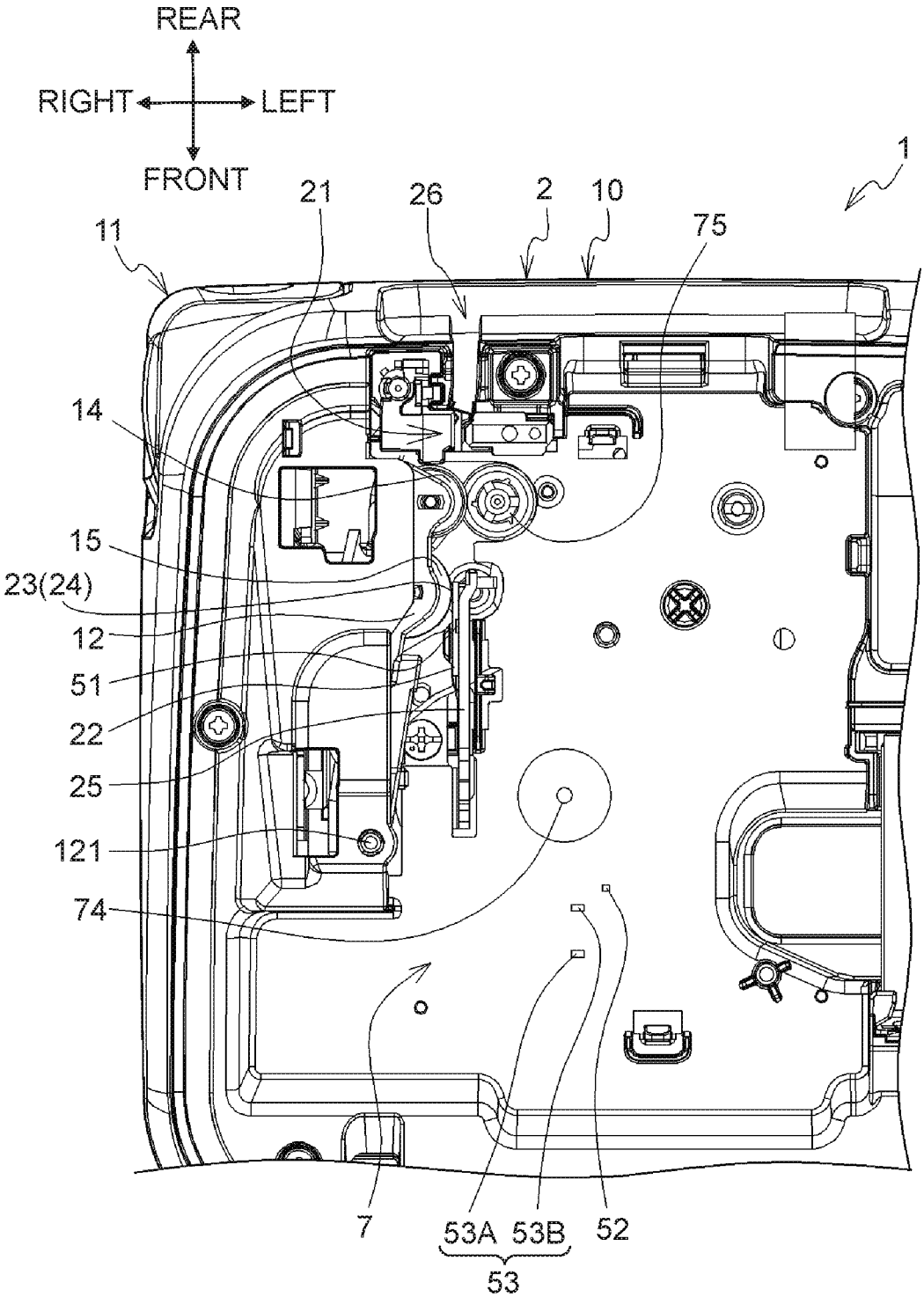
FIG. 2 is a bottom view of the printing apparatus with a second cover removed, and depicts a state in which a tape cassette is not installed (uninstalled state).
Figure 3:
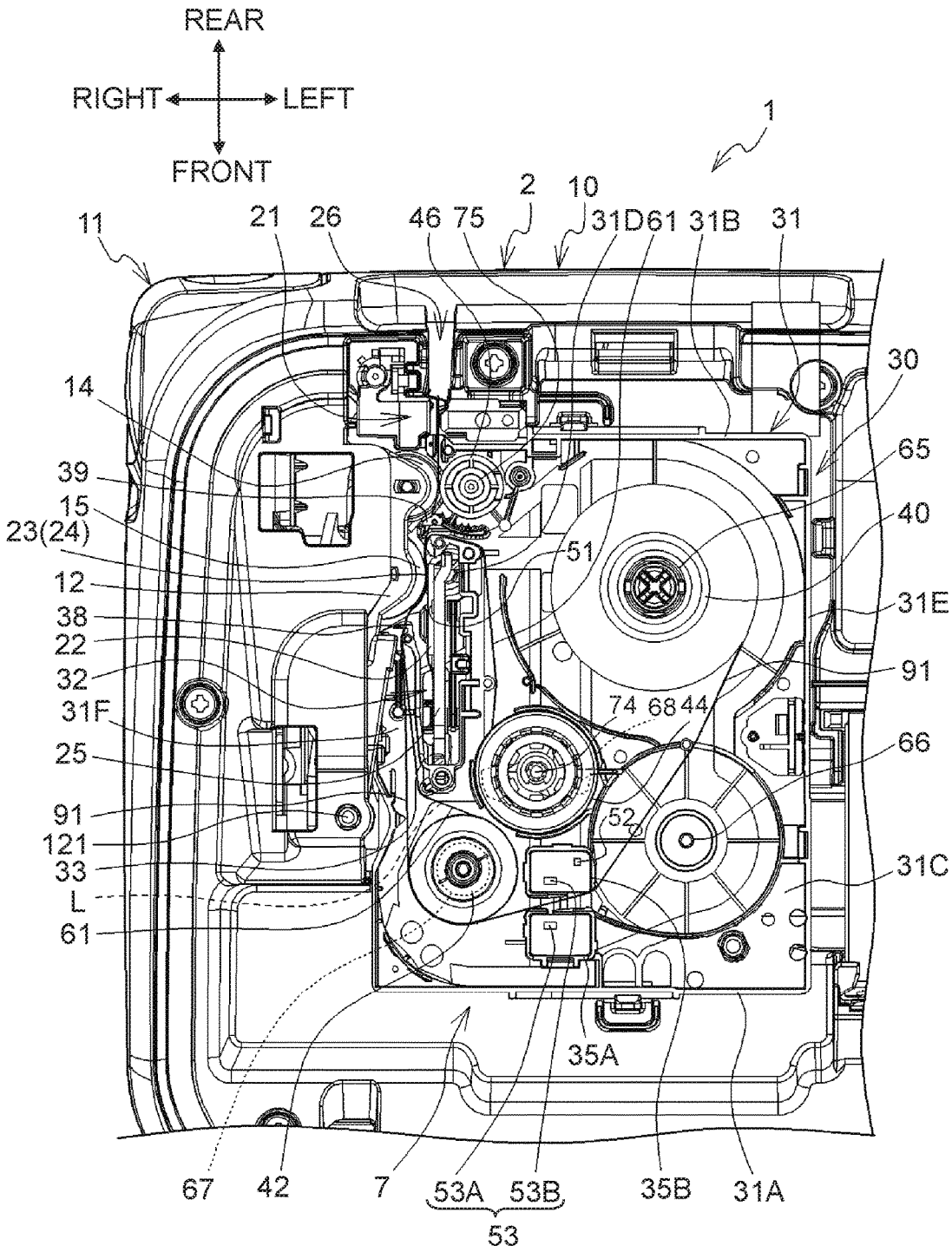
FIG. 3 is a bottom view of the printing apparatus with the second cover removed, and depicts a state in which the tape cassette is installed (installed state).

As depicted in FIG. 2, the cutting mechanism 21 is provided near a front side of the discharge port 26. The cutting mechanism 21 is capable of cutting-off a portion of the tape subjected to printing. The installing portion 7 is a space dented upward, which is demarcated by a lower surface of the first cover 2. The tape cassette 30 (refer to FIG. 3) is installed from a lower side on the installing portion 7, to be detachable in the vertical direction. In the following description, a state of the tape cassette 30 installed on the installing portion 7 will be referred to as "installed state" (refer to FIG. 3).

As depicted in FIG. 3, the tape cassette 30 includes a cassette case 31. The cassette case 31 is formed to be substantially rectangular-parallelepiped. More elaborately, the cassette case 31 includes a front wall 31A, a rear wall 31B, an upper wall 31C, a lower wall (omitted in the diagram), a right wall 31D, and a left wall 31E. Each of the front wall 31A, the rear wall 31B, the upper wall 31C, the lower wall, the right wall 31D, and the left wall 31E is in the form of a substantially rectangular plate. In the installed state, an upper surface of the upper wall 31C is facing a bottom surface of the installing portion 7 in the vertical direction. A protruding portion 31F is provided to the right wall 31D. The protruding portion 31F is extended in a right rearward direction from a front-end portion of the right wall 31D. An opening portion 38 is provided to a front end of the protruding portion 31F. The opening portion 38 is extended in the vertical direction, and discharges the tape and an ink ribbon 61 from an interior of the cassette case 31 to an exterior. A guiding portion 39 is provided to a right-rearward angular portion of the cassette case 31. The tape discharged from the opening portion 38 passes through the guiding portion 39, and is guided to the discharge port 26. The guiding portion 39 is extended in the vertical direction, and includes a hole that is cut through the right wall 31D in a leftward-rightward direction. The ink ribbon discharged from the opening portion 38 enters into the interior of the cassette case 31 from the guiding portion 39. A head insertion opening 32 is formed in a space enclosed by a left surface of the protruding portion 31F, the right wall 31D, and a virtual plane connecting the opening portion 38 and the guiding portion 39 (the tape between the opening portion 38 and the guiding portion 39). The head insertion opening 32 is a space in the vertical direction through the cassette case 31. In the following description, a wall portion in which the head insertion opening 32 is formed will be referred to as "head insertion wall portion 33". The head insertion wall portion 33 is a wall portion that is that runs continuously between the opening portion 38 and the guiding portion 39, of the protruding portion 31F and the right wall 31D, and is formed of an opaque resin material.

Through holes 35A and 35B are formed in the upper wall 31C. The through holes 35A and 35B are cut in the vertical direction through a substantially central portion in the leftward-rightward direction of a front portion of the upper wall 31C. The through hole 35B is arranged at a rear side of the through hole 35A with the tape in between. A tape drive roller 46 is provided to the rear right angular portion of the cassette case 31. The drive roller 46 is in a tubular form extended in the vertical direction, and is rotatably supported by the cassette case 31.

The cassette case 31 has supporting holes 65, 66, 67, and 68 (hereinafter, referred to as "supporting holes 65 to 68"). A first tape is wound around a first tape spool 40. The supporting hole 67 rotatably supports a ribbon spool 42. The unused ink ribbon 61 is wound around the ribbon spool 42. The supporting hole 68 rotatably supports a ribbon take-up spool 44. The used ink ribbon 61 is taken-up and wound around the ribbon take-up spool 44. The supporting hole 66 rotatably supports a second tape spool (omitted in the diagram). A second tape is wound around the second tape spool.

As the tape cassettes 30, it is possible to mount tape cassettes of various types such as the thermal type, the receptor type, the laminate type, and the tube type mentioned above, by changing appropriately the type of tape to be accommodated inside the cassette case 31, and the presence and absence of the ink ribbon 61. FIG. 2 exemplifies the tape cassette 30 of the receptor type. In the tape cassette 30 of the receptor type, the supporting hole 65 supports the first tape spool 40 to which the printing tape 91 has been wound as the first tape. Since the second tape is not used, the supporting hole 66 does not support the second tape spool.

As depicted in FIG. 2 and FIG. 3, in the installing portion 7, a heat sink 25 is provided to a front side of the cutting mechanism 21. The heat sink 25 is in the form of a plate extended in the frontward-rearward direction from the bottom surface of the installing portion 7. A substrate 22 is provided to a right surface of the heat sink 25. A thermal head 23 is arranged near a rear-end portion of a right surface of the substrate 22. The thermal head 23 includes a plurality of heating elements 24 arranged along the vertical direction. The heating elements 24 generate heat by an energy being applied thereto. The heat sink 25 releases heat of the heating elements 24 which have generated heat. More elaborately, the heat of the heating elements 24 is transmitted to the heat sink 25 via the substrate 22. The heat sink 25 releases the heat transferred via the substrate 22, to an outside (outside air) of the printing apparatus 1.

In the installing portion 7, a ribbon take-up shaft 74 is erected leftward (on a left side) of the heat sink 25. The ribbon take-up spool 44 is detachable from the ribbon take-up shaft 74. A tape drive shaft 75 is erected on a rear side of the heat sink 25. The tape drive roller 46 is detachable from the tape drive shaft 75.

A platen holder 12 is arranged on a right side of the thermal head 23. The platen holder 12 is pivotable in the leftward-rightward direction with a shaft portion 121 as a center. The shaft portion 121 is extended in the vertical direction. Each of a platen roller 15 and a movable conveyance roller 14 is rotatably supported by a rear-end portion of the platen holder 12. The platen roller 15 is opposite to the thermal head 23, sandwiching a conveyance path of the tape and a conveyance path L of the ink ribbon 61 in between, and is capable of coming closer to and being separated apart from the thermal head 23. The movable conveyance roller 14 is opposite to the tape drive roller 46 installed on the tape drive shaft 75, sandwiching the conveyance path of the tape in between, and is capable of coming closer to and being separated apart from the tape drive roller 46.

In the arrangement described above, the tape cassette 30 is to be attached to or detached from (to be installed on or removed from) the printing apparatus 1 in a state of the printing apparatus 1 turned upside down by the user such that an upper-surface side of the main body 10 is directed downward, and the second cover 3 is in the open state. In the installed state, a direction of width of the ink ribbon 61 and the printing tape 91 coincides with the vertical direction. Moreover, in the installed state, the substrate 22 and the heat sink 25 are inserted into the head insertion opening 32. When the second cover 3 is in the closed state, the thermal head 23 and the platen roller 15 come closer mutually. In a case in which, the ink ribbon 61 is arranged between the platen roller 15 and the thermal head 23, the platen roller 15 pushes the ink ribbon 61 and the printing tape 91 overlapping in the leftward-rightward direction, toward the thermal head 23. At this time, the ink ribbon 61 is arranged on a left side of the printing tape 91 (the thermal head 23 side).

The ribbon take-up shaft 74, by being rotated by the drive of the conveyance motor 88 (refer to FIG. 4), takes up the used ink ribbon 61, as well as draws the unused ink ribbon 61 from the ribbon spool 42 and conveys along the conveyance path L. The conveyance path L is a path along a virtual line orthogonal to a direction in which the plurality of heating elements 24 is arranged (the vertical direction). The conveyance path L runs from a point at which the ink ribbon 61 is drawn from the ribbon spool 42 up to the opening portion 38, then between the platen roller 15 and the thermal head 23, and upon passing the guiding portion 39, is extended up to the ribbon take-up spool 44. The tape drive shaft 75, by being rotated by a drive of the conveyance motor 88, rotates the tape drive roller 46. The tape drive roller 46 conveys the printing tape 91 by sandwiching between the movable conveyance roller 14 and the tape drive roller 46. At this time, the direction of width of the ink ribbon 61 and the printing tape 91 is in the vertical direction. The thermal head 23 prints characters in the units of lines by transferring the ink of the ink ribbon 61 to the printing tape 91 by the heating elements 24 generating heat selectively.

The installing portion 7 is provided with a first thermistor 51, a second thermistor 52, and an end detecting sensor 53. The first thermistor 51 is provided on the side of the thermal head 23, with respect to the conveyance path L in the installing portion 7. The first thermistor 51 is provided in a surrounding space including the thermal head 23. In the present embodiment, the first thermistor 51 is provided at a front side of the thermal head 23, on the substrate 22. The first thermistor 51, in the installed state, is arranged inside the head insertion opening 32. The first thermistor 51 is a temperature sensor which is capable of detecting temperature. More elaborately, the first thermistor 51 detects a temperature of the substrate 22 and a temperature of the heat sink 25. In the present embodiment, the temperature of the substrate 22 and the temperature of the heat sink 25 are treated to be equal.

The second thermistor 52 is provided to the bottom surface of the installing portion 7 in the installed state, at a position corresponding to the through hole 35B in the cassette case 31. The second thermistor 52, in the installed state, enters into the interior of the cassette case 31 through the through hole 35B. The second thermistor 52 is a temperature sensor which is capable of detecting temperature. More elaborately, the second thermistor 52 detects an ambient temperature of the interior of the cassette case 31.

The end detecting sensor 53 is a widely-known transmission-type photo sensor, and includes a light-emitting portion 53A and a light-receiving portion 53B. The light-emitting portion 53A, in the installed state, is provided to the bottom surface of the installing portion 7, at a position corresponding to the through hole 35A in the cassette case 31. The light-emitting portion 53A enters into the interior of the cassette case 31 through the through hole 35A, in the installed state. The light-receiving portion 53B, in the installed state, is provided to the bottom surface of the installing portion 7, at a position corresponding to the through hole 35B in the cassette case 31. The light-receiving portion 53B, in the installed state, enters into the interior of the cassette case 31 through the through hole 35B. The light-emitting portion 53A and the light-receiving portion 53B, in the installed state, are facing in the frontward-rearward direction, with the tape in between the two.

The end detecting sensor 53 detects an end mark of black color (omitted in the diagram) printed in advance on the tape inside the tape cassette 30. The end mark is printed at a position at a predetermined length from a trailing end of the tape. The end detecting sensor 53 irradiates light from the light-emitting portion 53A toward the light-receiving portion 53B. The light emitted from the light-emitting portion 53 is transmitted through the tape, and reaches the light-receiving portion 53B. The end detecting sensor 53 receives the light transmitted through the tape by the light-receiving portion 53B. The light emitted from the light-emitting portion 53A is not transmitted through the end mark. The end detecting sensor 53 detects the end mark on the basis of an intensity of light received by the light-receiving portion 53B. Accordingly, the end detecting sensor 53 outputs a signal indicating a tape end (in other words, indicating that the amount of tape remained is zero) of the tape cassette 30 installed.

Figure 4:
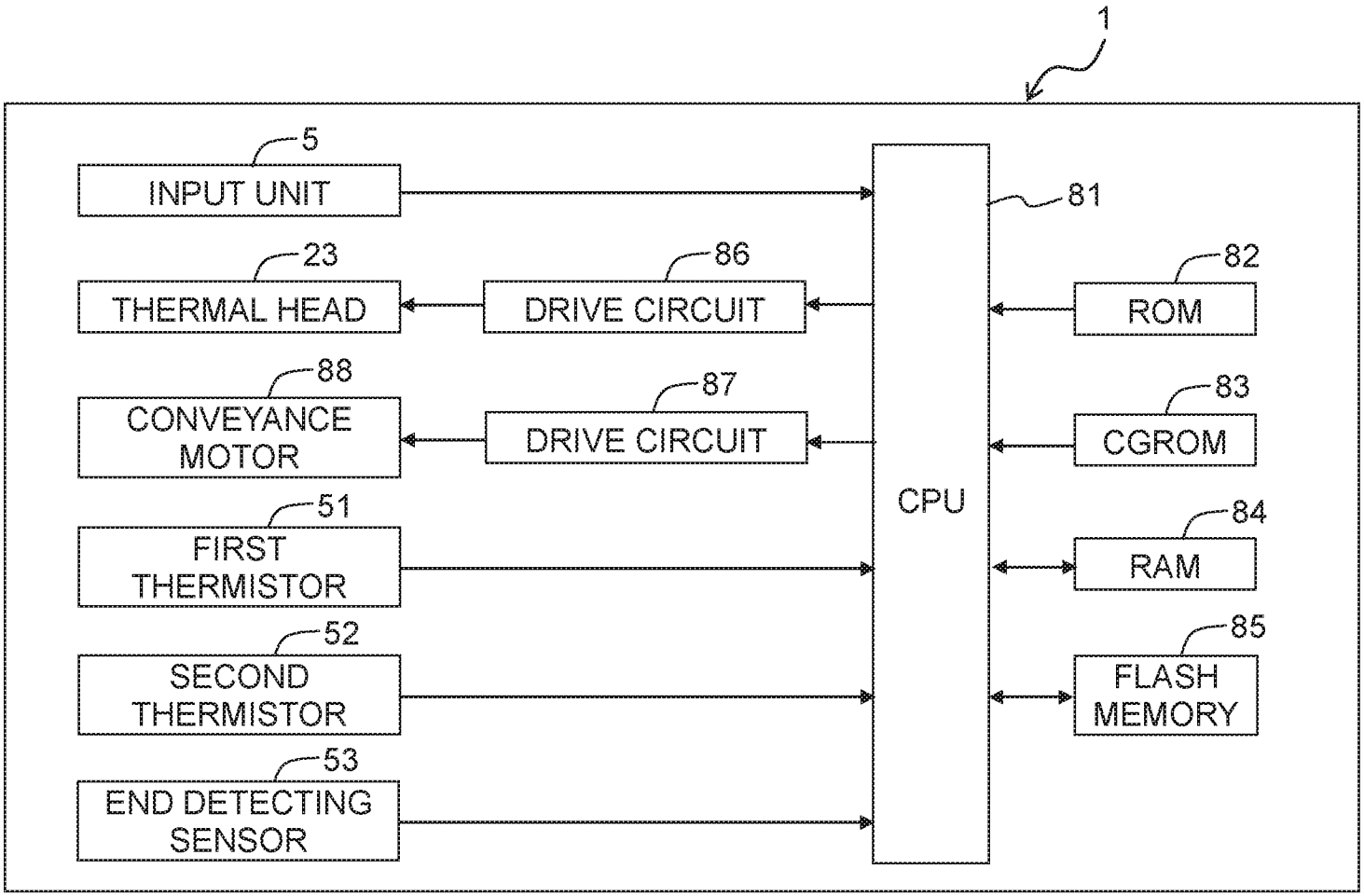
FIG. 4 is a block diagram depicting an electrical configuration of the printing apparatus.

An electrical configuration of the printing apparatus 1 will be described below by referring to FIG. 4. The printing apparatus 1 includes a CPU (central processing unit) 81 which carries out an integrated control of the printing apparatus 1. The CPU 81 is connected to a ROM (read only memory) 82, a CGROM (character generator read only memory) 83, a RAM (random access memory) 84, a flash memory 85, the input section 5, drive circuits 86 and 87, the first thermistor 51, the second thermistor 52, and the end detecting sensor 53.

The ROM 82 stores various parameters that are necessary when the CPU 81 executes various computer programs. Print data for test printing for example (hereinafter, referred to as "test print data") and design parameters that will be described later are stored in the ROM 82. In the present embodiment, for identifying media parameters that will be described later, a test printing is carried out before carrying out normal printing. The test print data includes print data of a plurality of patterns that have been determined in advance for carrying out printing in which the media parameters can be identified. The CGROM 83 stores dot-pattern data for printing characters. The RAM 84 includes a plurality of storage area such as a text memory and print buffer. The flash memory 85 stores various computer programs which the CPU 81 executes for controlling the printing apparatus 1. Print data acquired from an external terminal for example is stored in the flash memory 85. The drive circuit 86 is an electronic circuit for driving the thermal head 23. The drive circuit 87 is an electronic circuit for driving the conveyance motor 88.

In the present embodiment, the CPU 81, on the basis of the print data, applies energy selectively to the plurality of heating elements 24. The CPU 81 corrects an amount of the energy to be applied (hereinafter, referred to as "applying energy") to the plurality of heating elements 24. Accordingly, the printing apparatus 1 is capable of reducing a printing defect. In a case of correcting an amount of applying energy, information of temperature of the plurality of heating elements 24 and information of temperature of the ink ribbon 61 which is heated directly by the heating elements 24 are necessary. The printing apparatus of the present embodiment acquires the information necessary for correcting the applying energy as described below.

An equation of state that is established in a system including n number of elements (here, n is a natural number) will be described. Variables, vectors, and matrices to be used in the following description will be described below. In the following description, t is a variable and denotes time. Moreover, $T_k(t)$ is a vector which includes n real numbers, and is a function of t. Here, $T_k(t)$ denotes temperature of $k^{th}$ (k=1, 2, 3, . . . , n) element. Moreover, $T_k(0)$ denotes an initial value of temperature. Furthermore, A is a matrix including real numbers of n rows and n columns, and indicates relationship of flow of heat for each element. More elaborately, A denotes a thermal capacity and a coefficient of heat transfer of each element, and indicates an amount of heat stored in each element, a heat transfer path to each element, and an amount of heat transferred to each element. B is a matrix including real numbers of n rows and m columns, and corrects the equation. Moreover, u(t) is a vector which includes m real numbers, and is a function of t. Furthermore, u(t) indicates an amount of energy that is inputted to the system. Moreover, $T_{airZ}$ denotes an ambient temperature outside the system, and is let to be constant.

When the energy u(t) is inputted to the system, there is transfer of heat between elements, and between each element and an atmosphere outside the system. In this case, expression (l) expressed by a simultaneous differential equation on the basis of modern control theory is established.

[Expression 1]

$$\frac{d}{dt}\begin{bmatrix} T_1(t) - T_{airZ} \\ \vdots \\ T_n(t) - T_{airZ} \end{bmatrix} = A\begin{bmatrix} T_1(0) - T_{airZ} \\ \vdots \\ T_n(0) - T_{airZ} \end{bmatrix} + Bu(t) \tag{1}$$

By solving expression (1), expression (2) is achieved.

[Expression 2]

$$\begin{bmatrix} T_1(t) - T_{airZ} \\ \vdots \\ T_n(t) - T_{airZ} \end{bmatrix} = e^{At}\begin{bmatrix} T_1(0) - T_{airZ} \\ \vdots \\ T_n(0) - T_{airZ} \end{bmatrix} + \int_0^t e^{A(t-\tau)}Bu(\tau)d\tau \tag{2}$$

In expression (2), A is assumed to be a known number. In other words, $e^{At}$ and a second item on the right-hand side, are assumed to be known values. In this case, the number of unknown values is 2n which includes n number of the initial temperatures ($T_k(0)$) of each element, and n number of the temperatures ($T_k(t)$) at the time t. Expression (2) being a simultaneous expression including n number of equations, when n number of unknown parameters are identified, all the unknown parameters are determined.

When one temperature sensor is arranged for one specific element, two unknown parameters, which are the initial temperature and the temperature at time t, are identified for one element. Therefore, when two temperature sensors are arranged for mutually different elements (positions), four unknown parameters are identified. In this case, when the remaining (n−4) number of unknown parameters are identified, all the unknown parameters are determined.

Expression (2) is applied to a system which includes the head insertion opening 32 and the tape cassette 30. The system which includes the head insertion opening 32 and the tape cassette 30 of the present embodiment includes five elements (in other words, n=5) for example. More specifically, the five elements are the thermal head 23, the heat sink 25, the atmosphere of the head insertion opening 32, the atmosphere of the interior of the cassette 31, and the ink ribbon 61. In this system, when the energy to be applied is applied to the heating elements 24, a part of the heat of the heating elements 24 flows to the heat sink 25 and the ink ribbon 61. The heat flowed to the ink ribbon 61 flows to an outside of the system. A part of the heat flowed to the heat sink 25 flows to the outside of the system, and to the head insertion opening 32. A part of the heat flowed to the head insertion opening 32 flows to the interior of the cassette case 31 via the head insertion wall portion 33. In the expression used in the following description, the thermal head 23 is denoted by h, the heat sink 25 is denoted by hs, the atmosphere of the head insertion opening 32 is denoted by airA, the atmosphere of the interior of the cassette case 31 is denotes by airB, and the ink ribbon 61 (media) is denoted by m. For example, $T_h(0)$ denotes an initial temperature of the thermal head 23. Moreover, $T_{airZ}$ denotes a temperature of the atmosphere (ambient air) of the outside of the system, and is equal to the initial temperature of the atmosphere of the interior of the cassette case 31. Furthermore, $u(\tau)$ denotes the energy applied at the time $t=\tau$. In this case, expression (3) is established on the basis of expression (2).

[Expression 3]

$$\begin{bmatrix} T_h(t)-T_{airZ} \\ T_{hs}(t)-T_{airZ} \\ T_{airA}(t)-T_{airZ} \\ T_{airB}(t)-T_{airZ} \\ T_m(t)-T_{airZ} \end{bmatrix} = e^{At}\begin{bmatrix} T_h(0)-T_{airZ} \\ T_{hs}(0)-T_{airZ} \\ T_{airA}(0)-T_{airZ} \\ T_{airB}(0)-T_{airZ} \\ T_m(0)-T_{airZ} \end{bmatrix} + \int_0^t e^{A(t-\tau)}Bu(\tau)d\tau \tag{3}$$

In expression (3), A includes design parameters and media parameters. The design parameters are known values determined in advance by design items of the printing apparatus 1. The design parameters, for example, are a thermal capacity of each of the thermal head 23, the heat sink 25, the atmosphere of the head insertion opening 32, the atmosphere of the interior of the cassette case 31, and a coefficient of heat transfer between the thermal head 23, the heat sink 25, the atmosphere of the head insertion opening 32, the atmosphere of the interior of the cassette case 31 when there is a heat transfer between the thermal head 23, the heat sink 25, the atmosphere of the head insertion opening 32, and the atmosphere of the interior of the cassette case 31. The coefficient of heat transfer, as a design parameter, is a coefficient of heat transfer between the thermal head 23 and the heat sink 25, a coefficient of heat transfer between the heat sink 25 and the atmosphere of the head insertion opening 32, a coefficient of heat transfer between the heat sink 25 and the atmosphere of the outside of the system, and a coefficient of heat transfer between the atmosphere of the interior of the cassette case 31 and the atmosphere of the head insertion opening 32 demarcated by the head insertion wall portion 33.

The media parameters are unknown values that depend on a type of the ink ribbon 61 (such as a material, a width, and a thickness of the ink ribbon 61). The media parameters include parameters such as a thermal capacity of the ink ribbon 61 and a coefficient of heat transfer between the ink ribbon 61 and the thermal head 23. In the present embodiment, the media parameters are identified by the test printing. Accordingly, in expression (3), since A is identified, $e^{At}$ and a second item on a right-hand side of the expression, are known values that can be expressed in terms of t. Therefore, by the test printing, the initial temperature of each element and temperature at the time t of each element are the only unknown parameters in expression (3). Since expression (3) is a simultaneous equation including five equations, when the unknown parameters are not more than five, the printing apparatus is capable of computing all the parameters (the initial temperature and the temperature at the time t of all elements).

In the present embodiment, the printing apparatus 1 includes only two thermistors which are the first thermistor 51 and the second thermistor 52, as temperature sensors to be used for correction of the applying energy. In the printing apparatus 1, by arranging the first thermistor 51 and the second thermistor 52 at specific positions as mentioned above, it is possible to identify approximately, the initial temperature of the ink ribbon 61, in addition to be able to identify the temperature (initial temperature and the temperature at the time t) of two elements. More specifically, from the temperature detected by the first thermistor 51 (hereinafter, referred to as "first temperature"), $T_{hs}(t)$ and $T_{hs}(0)$ are identified. From the temperature detected by the second thermistor 52 (hereinafter, referred to as "second temperature"), $T_m(0)$ is identified approximately in addition to $T_{airB}(t)$ and $T_{airB}(0)$ being identified. As mentioned above, $T_{airZ}$ is equal to $T_{airB}(0)$. Accordingly, the number of unknown parameters in expression (3) becomes five which are $T_h(t)$, $T_h(0)$, $T_{airA}(t)$, $T_{airA}(0)$, and $T_m(t)$. Hereinafter, the five unknown parameters will be collectively referred to as "parameters to be identified". The parameters to be identified, from among the unknown values independent of the type of ink ribbon 61, are variables which cannot be identified only on the basis of the first temperature and also cannot be identified only on the basis of the second temperature. The number of parameters to be identified is five, and since expression (3) is a simultaneous equation including five equations, the printing apparatus 1 is capable of computing all the parameters on the basis of expression (3), by using the temperatures detected by the two thermistors (the first thermistor 51 and the second thermistor 52). Accordingly, the printing apparatus 1 is capable of correcting the amount of applying energy with high accuracy based on the parameters computed, while suppressing an increase in the number of thermistors.

Figure 5A:
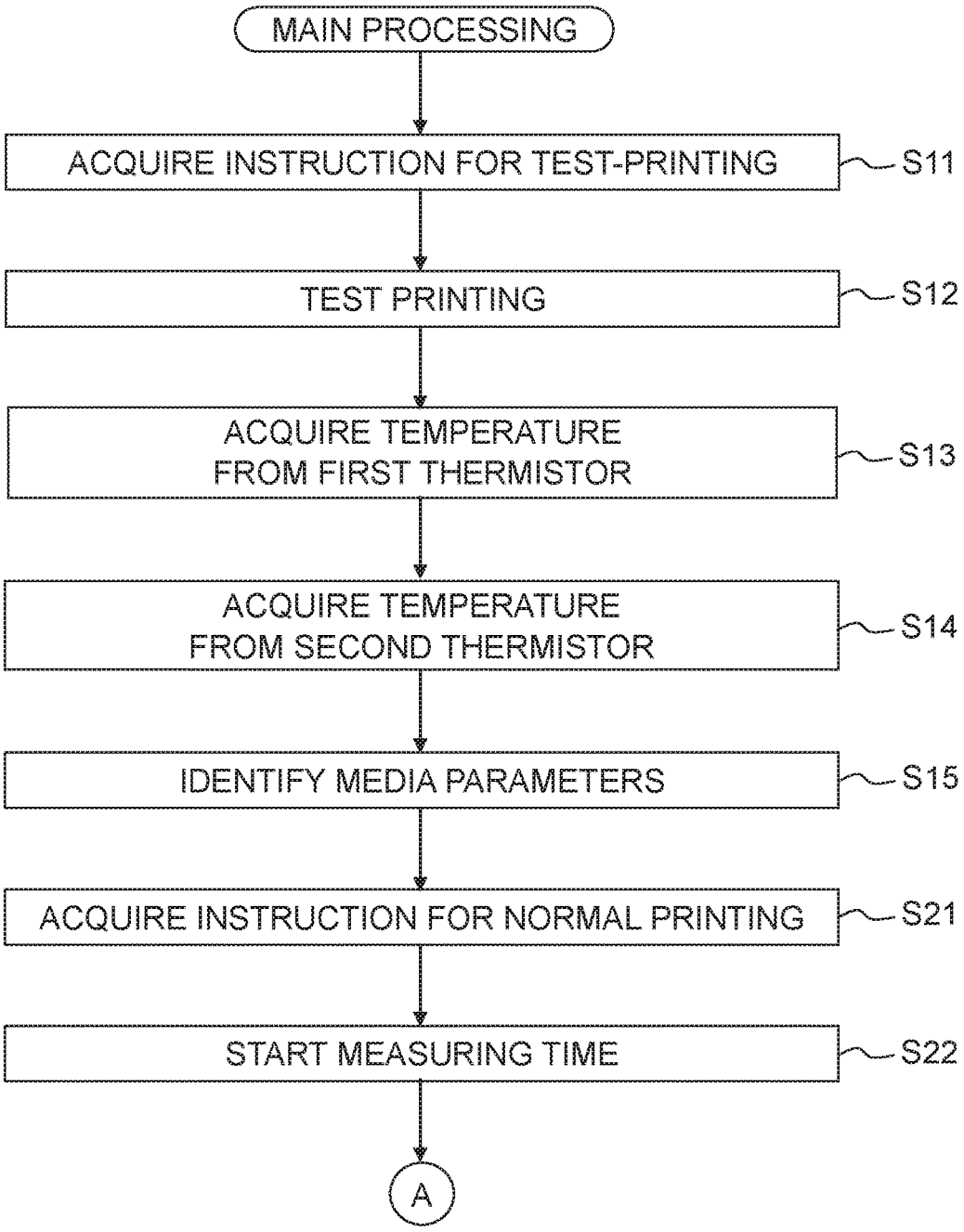
FIGS. 5A and 5B are a flowchart of a main processing.
Figure 5B:
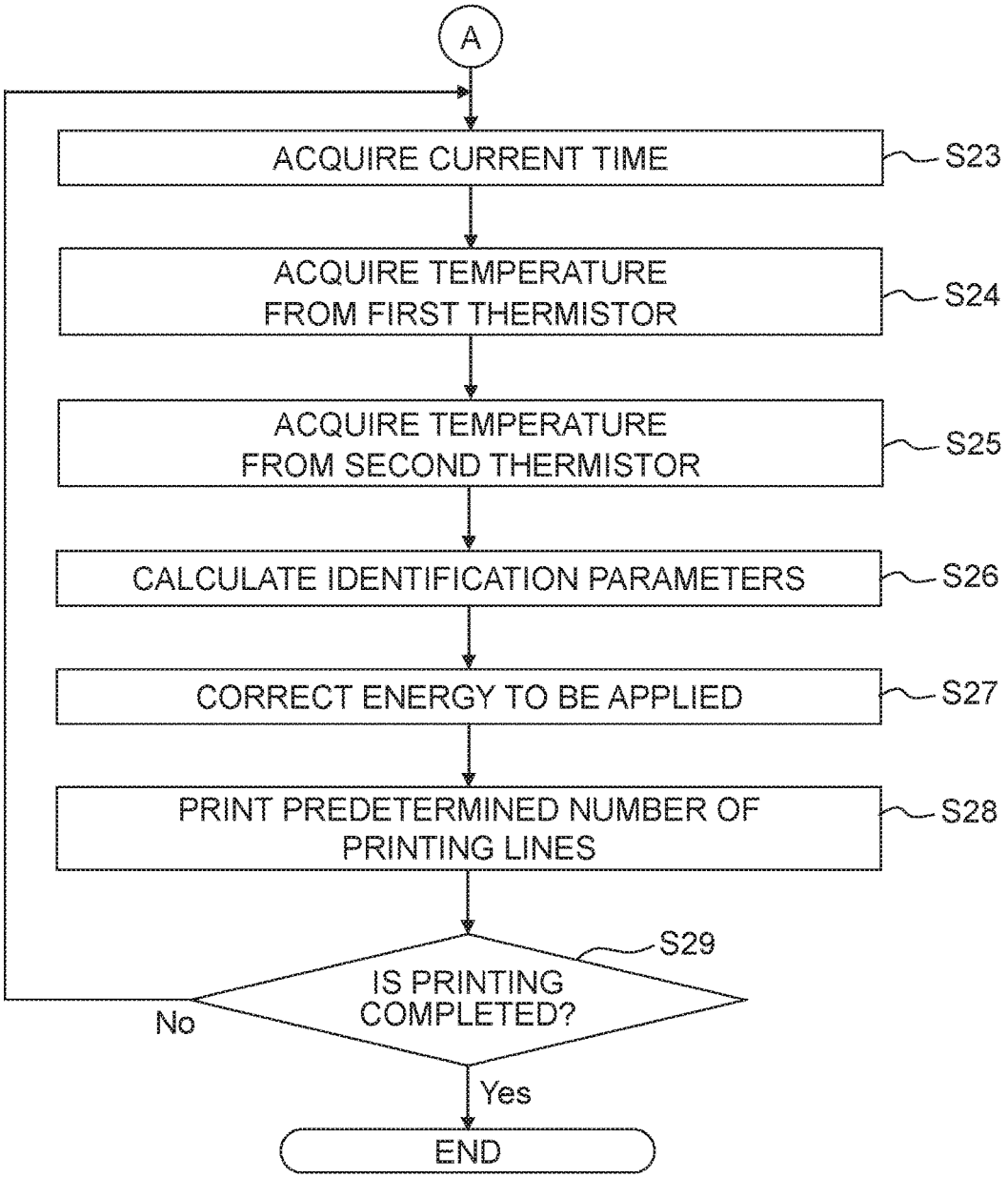

A main processing will be described below by referring to FIG. 5. A user operates a power-supply switch of the input unit 5, and starts-up the printing apparatus 1. When the printing apparatus 1 is started, the CPU 81 starts the main processing by executing a computer program stored in the ROM 82.

In the present embodiment, as mentioned above, the test printing is carried out prior to the normal printing. The user operates the input unit 5 and inputs an instruction for test printing to the CPU 81. The CPU 81 acquires the instruction for test printing inputted by the user (step S11). The CPU 81 reads out test printing data from the ROM 82, and executes the test printing on the basis of the test printing data (step S12). The CPU 81 acquires the first temperature from the first thermistor 51 (step S13). The CPU 81 acquires the second temperature from the second thermistor 52 (step S14). The CPU 81, on the basis of the first temperature and the second temperature acquired at steps S13 and S14, identifies the media parameters approximately (step S15). Accordingly, A in expression (3) is identified. Values of the media parameters identified approximately at step S15 are stored in the RAM 84. An accuracy of identifying the values of the media parameters may be improved by repeating step S12 to S14 for a plurality of times by the CPU 81.

As the test printing is completed, the user inputs an instruction for normal printing to the CPU 81 via the input unit 5. The CPU 81 acquires the instruction for normal printing inputted by the user (step S21). The instruction for normal printing includes the print data. The CPU 81 starts measuring time by a timer counter of the RAM 84 (step S22). The CPU 81 refers to the timer counter of the RAM 84, and acquires a current time (step S23). The current time is denoted by tin expression (3), and is 0 in the initial state (in other words, t=0). The current time acquired at step S23 is stored in the RAM 84.

The CPU 81 acquires the first temperature from the first thermistor 51 (step S24). The CPU 81 acquires the second temperature from the second thermistor 52 (step S25). The temperatures acquired at steps S24 and S25 are stored in the RAM 84. The CPU 81 compute the parameters to be identified on the basis of expression (3), by using the design parameters that have been stored in the ROM 82 in advance, the media parameters stored in the RAM 84 at step S15, the current time (t) stored in the RAM 84 at step S23, and the first temperature and the second temperature stored in the RAM 84 at steps S24 and S25 (step S26). Values of the parameters to be identified computed at step S26 are stored in the RAM 84.

The CPU 81 corrects the amount of the applying energy on the basis of $T_h$ and $T_m$ computed at step S26, by a known method (step S27). The amount of the applying energy that has been corrected at step S27 is stored in the RA M 84. The CPU 81 prints a predetermined number of printing lines on the basis of the applying energy corrected at step S27 (step S28). More elaborately, the conveyance motor 88 is controlled, and the printing tape 91 and the ink ribbon 61 of a length equivalent to the predetermined number of printing lines, are conveyed. In synchronization with conveying the printing tape 91 and the ink ribbon 61 equivalent to the predetermined number of printing lines, the amount of energy to be applied that has been corrected at step S27 is applied to the plurality of heating elements 24 for each printing line. At this time, the CPU 81, on the basis of the printing data, selectively applies the amount of energy to be applied that has been corrected, to the plurality of heating elements and generates heat. Printing is carried out by transferring the ink of the ink ribbon 61 to the printing tape 91 by using the heating elements 24 which have generated heat. Consequently, the printing apparatus 1 is capable of suppressing a printing defect caused due to the energy to be applied.

The CPU 81 determines whether the printing is to be terminated (step S29). In a case where data of printing lines, that have not been printed yet, has remained in the printing data, the CPU 81 determines not terminating the printing (NO at step S29). The CPU 81 returns the processing to step S23. In other words, the correction of the amount of applying energy (step S27) is carried out for printing of the predetermined number of printing lines every time. Therefore, the smaller the predetermined number (of printing lines), the more improved is the accuracy of correction of the amount of the applying energy. Moreover, the larger the predetermined number (of printing lines), the more lightened is the control load on the CPU 81. In a case where there is no data remained of the printing lines that have not been printed in the printing data, the CPU 81 determines that the printing is to be terminated (YES at step S29). The CPU 81 terminates the main processing.

As described heretofore, the amount of applying energy is corrected on the basis of the first temperature and the second temperature (step S27). It has been known that, as the temperature of the thermal head 23 and the temperature of the ink ribbon 61 to which the heat is imparted by the heating elements 24 at the time of printing are identified, it is possible to correct with high accuracy, the amount of energy to be applied. In the installed state, the first thermistor 51 is arranged inside the head insertion opening 32. Consequently, an effect of heat from the thermal head 23 on the first thermistor 51 becomes substantial. Accordingly, deviation between change in the first temperature and change in the temperature of the thermal head 23 becomes small. In the installed state, the second thermistor 52 is arranged at the interior of the cassette case 31. Consequently, an effect of heat from the thermal head 23 on the second thermistor 52 becomes small. Accordingly, deviation between change in the second temperature and change in the temperature of the ink ribbon 61 becomes small. Therefore, the printing apparatus 1 is capable of correcting the amount of applying energy with high accuracy. Since the printing is carried out on the basis of the amount of applying energy that has been corrected, the printing apparatus 1 is capable of reducing a printing defect caused due to the applying energy.

Since the first thermistor 51 is provided on the substrate 22, it is possible to detect the temperature of the substrate 22 with high accuracy. Since the thermal head 23 is arranged on the substrate 22, deviation between the change in the first temperature and the change in the temperature of the thermal head 23 becomes small. Accordingly, the printing apparatus 1 is capable of correcting with high accuracy, the amount of energy to be applied.

Since the second thermistor 52 is provided to the installing portion 7, it is not necessary to provide the second thermistor 52 to each tape cassette 30. Accordingly, in the printing apparatus 1, it is possible to reduce a manufacturing cost of the tape cassette 30.

The light-receiving portion 53B and the second thermistor 52 enter into the interior of the cassette case 31 through one through hole 35B. Therefore, even in a case of including the end detecting sensor 53 and the second thermistor 52, it is not necessary to provide a separate through hole to the cassette case 31. Consequently, in the printing apparatus 1, it is possible to reduce a possibility of foreign matters such as dust, entering into the cassette case 31.

Since the head insertion wall portion 33 is made of an opaque resin material, a possibility of radiant heat from the thermal head 23 being transmitted to the interior of the cassette case 31 is reduced. Accordingly, since an effect of heat from the thermal head 23 on the second thermistor 52 becomes small, deviation between the change in the second temperature and the change in the temperature of the ink ribbon 61 becomes small. Consequently, the printing apparatus 1 is capable of correcting with high accuracy, the amount of energy to be applied.

As the printing is carried out, an amount of the ink ribbon 61 wound to the ribbon spool 42 decreases, and an amount of the printing tape 91 wound to the first tape spool 40 decreases. Accordingly, a ratio of a proportion of air occupying the interior of the cassette case 31 and a proportion of the unused ink ribbon 61 occupying the interior of the cassette case 31 changes. Even in this case, since the printing apparatus 1 executes steps S23 to S27 for each printing of the determined number of printing lines, it is possible to show the effect described above.

In the present embodiment, the tape cassette 30 corresponds to the "cassette" of the present teaching. The ink ribbon 61 corresponds to the "printing medium" of the present teaching. The vertical direction of the printing apparatus 1 corresponds to the "arrangement direction" of the present teaching. The conveyance path L corresponds to the "conveyance path" of the present teaching. The ribbon take-up shaft 74 corresponds to the "conveyor" of the present teaching. The first thermistor 51 corresponds to the "first temperature sensor" of the present teaching. The second thermistor 52 corresponds to the "second temperature sensor" of the present teaching. The upper wall 31C corresponds to the "facing wall" of the present teaching. The through hole 35B corresponds to the "through hole" of the present teaching. The light-receiving portion 53B corresponds to the "end-mark sensor" of the present teaching.

Figure 6:
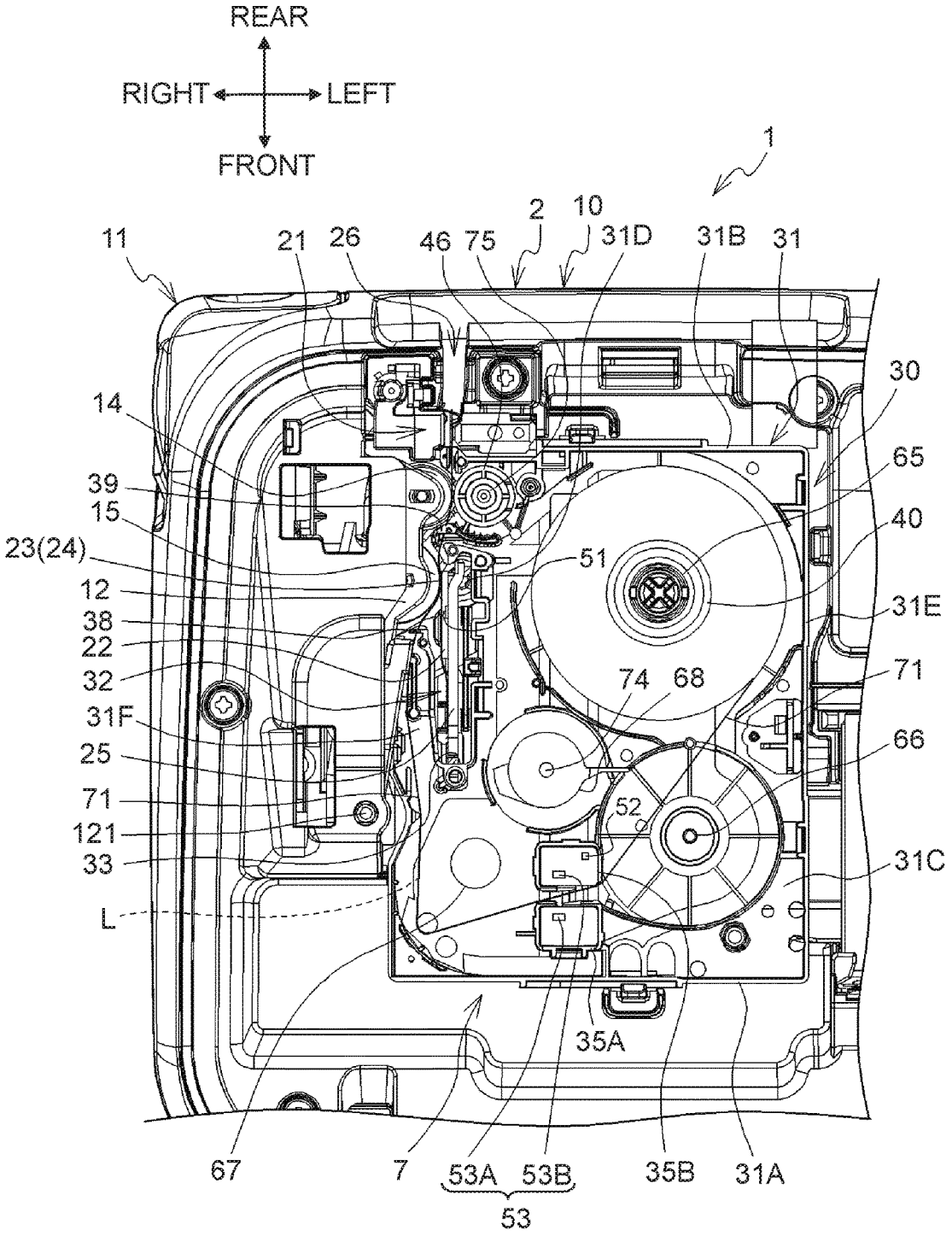
FIG. 6 is a bottom view of the printing apparatus with the second cover removed in a modified example, and depicts a state in which the tape cassette is installed (installed state).

It is possible to make various modifications in the embodiment of the present teaching. For instance, in the embodiment, the case in which the tape cassette of the receptor type is used was described. However, the present teaching is also applicable when a tape cassette of another type (such as the thermal type, the laminate type, and the tube type) is used. In this case, only a point that the type of the printing medium to be accommodated in the cassette case 31 is different differs from the embodiment. As depicted in FIG. 6, in the tape cassette 30 of the thermal type, the supporting hole 65 supports the first tape spool 40 around which the thermal paper tape 71 is wound as the first tape. Since the second tape is not used, the supporting hole 66 does not support the second tape spool. Moreover, since the ink ribbon 61 is also not used, the supporting holes 67 and 68 do not support the ribbon spool 42 and the ribbon take-up spool 44 respectively. In this case, the thermal paper tape 71 corresponds to the "printing medium" of the present teaching. The tape drive shaft 75 corresponds to the "conveyor". The conveyance path L of the thermal paper tape 71 runs from a point at which the thermal paper tape 71 is drawn from the first tape spool 40 up to a plurality of bent portions, the opening portion 38, then between the platen roller 15 and the thermal head 23, the guiding portion 39, and upon passing through the movable conveyance roller 14 and the tape drive roller 46, is extended up to the discharge port 26.

Even in a case of the tape cassette 30 being of the thermal type, expression (2) can be applied to a system including the installing portion 7 and the tape cassette 30 of the thermal type, similarly as in the embodiment. The system including the installing portion 7 and the tape cassette 30 of the thermal type includes five elements (in other words, n=5) for example. More specifically, the five elements are the thermal head 23, the heat sink 25, the atmosphere of the head insertion opening 32, the atmosphere of the interior of the cassette case 31, and the thermal paper tape 71. In this system, when the energy to be applied is applied to the heating elements 24, a part of the heat of the heating elements 24 flows to the heat sink 25 and the thermal paper tape 71. The heat flowed to the thermal paper tape 71 flows to an outside of the system. A part of the heat flowed to the heat sink 25 flows to the outside of the system and to the head insertion opening 32. A part of the heat flowed to the head insertion opening 32 flows to the interior of the cassette case 31. In this case, expression (3) is established on the basis of expression (2). Accordingly, even in the case in which the tape cassette 30 of the thermal type is used, the printing apparatus 1 is capable of showing an effect similar to that of the embodiment in which the tape cassette 30 of the receptor type is used.

In a tape cassette of the laminate type (omitted in the diagram), the supporting hole 65 supports the first tape spool 40 around which a two-sided adhesive tape is wound as the first tape. The supporting hole 66 supports the second tape spool around which a film tape is wound as the second tape. Since the ink ribbon 61 is used, the supporting holes 67 and 68 support the ribbon spool 42 and the ribbon take-up spool 44. In this case, the ink ribbon 61 corresponds to the "printing medium" of the present teaching. Even in a case in which the tape cassette of the laminate type is used, since expression (2) can be applied to a system including the installing portion 7 and the tape cassette 30 of the laminate type, similarly as in the embodiment, the printing apparatus 1 is capable of showing an effect similar to that in the embodiment.

In the embodiment, expression (2) was applied upon taking into consideration the five elements which are the thermal head 23, the heat sink 25, the atmosphere of the head insertion opening 32, the atmosphere of the interior of the cassette case 31, and the ink ribbon 61. However, without restricting to five, the number of elements may be six or more. For instance, in a case in which, one element is added to the five elements in the embodiment, expression (4) is established on the basis of expression (2). The element added is denoted by add1.

[Expression 4]

$$\begin{bmatrix} T_h(t) - T_{airZ} \\ T_{hs}(t) - T_{airZ} \\ T_{airA}(t) - T_{airZ} \\ T_{airB}(t) - T_{airZ} \\ T_m(t) - T_{airZ} \\ T_{add1}(t) - T_{airZ} \end{bmatrix} = e^{At} \begin{bmatrix} T_h(0) - T_{airZ} \\ T_{hs}(0) - T_{airZ} \\ T_{airA}(0) - T_{airZ} \\ T_{airB}(0) - T_{airZ} \\ T_m(0) - T_{airZ} \\ T_{add1}(0) - T_{airZ} \end{bmatrix} + \int_0^t e^{A(t-\tau)} Bu(\tau) d\tau \tag{4}$$

In expression (4), $T_{hs}(t)$ and $T_{hs}(0)$ are identified from the first temperature. Moreover, $T_m(0)$ is approximately identified in addition to $T_{airB}(t)$ and $T_{airB}(0)$ being identified from the second temperature. In other words, since five parameters are identified, the number of unknown parameters is seven. Expression (4) being a simultaneous expression including six expressions, when one more unknown parameter can be identified, the printing apparatus 1 is capable of computing all the parameters. Consequently, when it is possible to identify $T_{hs}(t)$, $T_{hs}(0)$, $T_{airB}(t)$, $T_{airB}(0)$, and $T_m(0)$, and when one of the first thermistor 51 and the second thermistor 52 is provided at a position where at least one of $T_{add1}(t)$ and $T_{add1}(0)$ can be identified approximately from either the first temperature or the second temperature, the printing apparatus 1 is capable of computing all the parameters.

For instance, sometimes a length of the cassette case 31 in the vertical direction is smaller than a length of the installing portion 7 in the vertical direction. In this case, a space (hereinafter, referred to as "upper-side space") is formed between the upper wall 31C of the cassette case 31 and the bottom surface of the installing portion 7. A part of the heat of the heating elements 24 flows to the upper-side space, and to the interior of the cassette case 31 via the upper wall 31C. Even in this arrangement, adding an atmosphere of the upper-side space as an element may be possible. In this case, the printing apparatus 1 may identify approximately, an initial temperature of the upper-side space from the second temperature. Accordingly, the number of unknown parameters becomes six, and since expression (4) is a simultaneous equation including six equations, the printing apparatus 1 is capable of calculating all the parameters on the basis of expression (4), by using the temperatures detected by the two thermistors (the first thermistor 51 and the second thermistor 52). Accordingly, the printing apparatus 1 is capable of correcting with high accuracy, the amount of energy to be applied, on the basis of the parameters calculated, while suppressing an increase in the number of thermistors. Without restricting the number of thermistors to two, the printing apparatus 1 may be provided with a third thermistor as the element added (upper-side space).

In the embodiment, the CPU 81 identifies the media parameters on the basis of the first temperature and the second temperature, by test printing. However, the method of identifying the media parameters is not restricted to the abovementioned method. For instance, a table in which the types of the ink ribbon 61 and the media parameters are associated may be stored in the ROM 82. In this case, the CPU 81 may acquire the type of the ink ribbon 61 at least before the processing at step S25. The CPU 81 may acquire the type of the ink ribbon 61 which the user has input by operating the input section 5. The tape cassette 30 may include an identification portion (such as an IC tag) which enables to identify the type of the ink ribbon 61. The printing apparatus 1 may include a reading section. The CPU 81 may acquire the type of the ink ribbon 61 by reading out the identification portion of the tape cassette 30 via the reading section, in the installed state. The CPU 81 may acquire from the table, the media parameters corresponding to the type of the ink ribbon 61 acquired. In this case, it is possible for the printing apparatus 1 to omit the processing at steps S11 to S15, and to save the trouble of test printing.

The position at which the first thermistor 51 is to be provided is not restricted to the substrate 22. The first thermistor 51 may be provided to the heat sink 25 for example, or may be provided to the thermal head 23. In the installed state, the first thermistor 51 may be provided around the heat sink 25, in the installing portion 7, provided that it is inside the head insertion opening 32. The closer the position at which the first thermistor 51 is provided, to the thermal head 23, the higher is the accuracy with which the CPU 81 is capable of calculating the temperature of the thermal head 23 at step S26.

A position at which the second thermistor 52 is to be provided is not restricted to the position in the embodiment. The second thermistor may be provided to the bottom surface of the installing portion 7, at a position corresponding to the through hole 35A, in the installed state. The cassette case 31 may have a through hole (hereinafter, referred to as "specific through hole") in the upper wall 31C, different from the through holes 35A and 35B. The second thermistor 52, in the installed state, may be provided to the bottom of the installing portion 7, at a position corresponding to the specific through hole. At this time, the second thermistor 52, in the installed state, enters into the interior of the cassette case 31 through the specific through hole. In this case, since the position at which the second thermistor 52 is arranged is not restricted to the position at which the end detecting sensor 53 is arranged, a degree of freedom of the position at which the second thermistor 52 is arranged becomes high.

Figure 7:
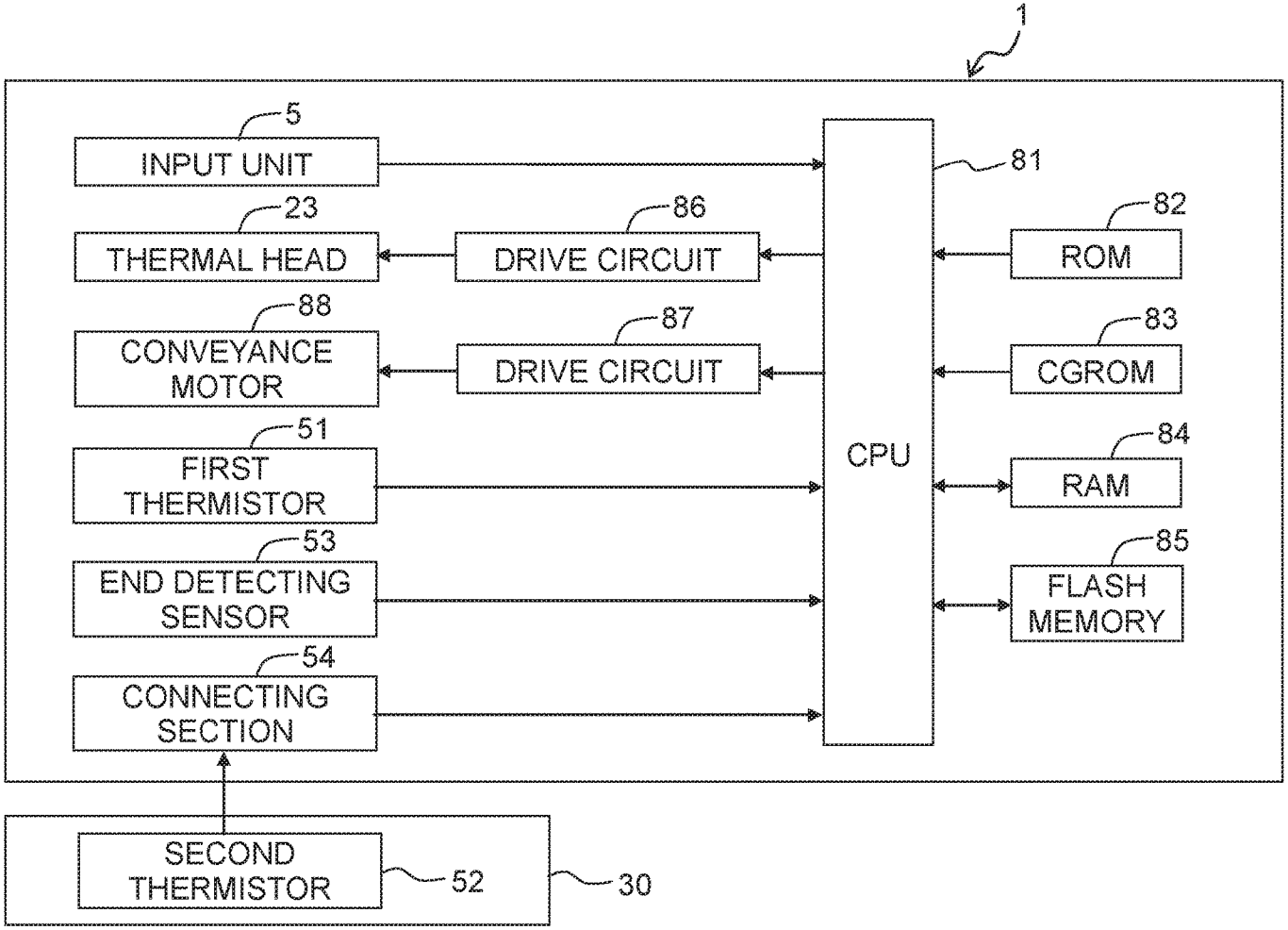
FIG. 7 is a block diagram depicting an electrical configuration of the printing apparatus and the tape cassette in a modified example.

As depicted in FIG. 7, the second thermistor 52 may be provided in advance at the interior of the cassette case 31 of the tape cassette 30. It is preferable that the second thermistor 52 is arranged at the interior of the cassette case 31, at a position not hindering conveyance of the ink ribbon 61 and the printing tape 91 (in other words, a position not blocking the conveyance path L of the tape). In this case, the installing portion 7 may be provided with a connecting section 54. The connecting section 54 may be provided to the bottom surface of the installing portion 7, at a position corresponding to the through hole 35B, in the installed state. The second thermistor 52, in the installed state, may be provided at the interior of the tape cassette 30, at a position corresponding to the connecting section 54 (near the through hole 35B for example). The connecting section 54 is connected to the CPU 81. The connecting section 54 is connectable to the second thermistor 52, and in the installed state, is connected to the second thermistor 52. The connecting section 54 supplies an electric power to the second thermistor 52 when connected to the thermistor 52. The CPU 81 detects the temperature from the second thermistor 52 via the connecting section 54. In this case, the second thermistor 52 is provided in advance to the tape cassette 30. Consequently, the printing apparatus 1 is capable of reducing a possibility of the second thermistor 52 being damaged by the cassette case 31 hitting the second thermistor 52 at the time of installing the tape cassette 30. The farther the position at which the second thermistor 52 is provided, from the thermal head 23, and the nearer the position at which the second thermistor 52 is provided, from the ink ribbon 61, the higher is the accuracy of identifying approximately the temperature of the ink ribbon 61 by the printing apparatus 1.

In the printing apparatus 1, another temperature sensor (such as a thermocouple) may be used instead of the first thermistor 51 and the second thermistor 52. In the embodiment, the head insertion wall portion 33 is made of an opaque resin material. However, the head insertion wall portion 33 may be transparent, semi-transparent, and may not be made of a resin material. The end detecting sensor 53 is not restricted to a transmission-type photo sensor, and may be a reflecting photo sensor, or may be another sensor.

In the present embodiment, the classification of the design parameters and the media parameters is merely an example. In the printing apparatus 1, some or all of the media parameters may be stored in advance in the ROM 82, as known values. Some or all of the design parameters may be treated as unknown values, and the design parameters may be identified by the test printing for example. In the printing apparatus 1, the coefficient of heat transfer between the atmosphere of the interior of the cassette case 31 and the atmosphere of the head insertion opening 32 demarcated by the head insertion wall portion 33 may be identified by test printing as an unknown value depending on the type of the head insertion wall portion 33 (such as a material, a width, and a thickness of the head insertion wall portion 33).

Instead of the CPU 81, a microcomputer, an ASIC (application specific integrated circuit), an FPGA (field programmable gate array) etc. may be used as a processor. The main processing may be distributed to a plurality of processors. The flash memory 85 may not include a transitory storage medium (such as a signal to be transmitted). The computer program may be downloaded from a server connected to the network (in other words, transmitted as a transmission signal), or may be stored in the flash memory 85. In this case, it is preferable that the computer program is saved in a non-transitory storage medium such as an HDD (hard disc drive) in a server.

What is claimed is:

1. A printing apparatus, comprising:

a main body in a box shape;

a cassette including a cassette case in a box shape and a printing medium accommodated in the cassette case;

an installing portion provided on the main body, the cassette being detachably installed in the installing portion;

a thermal head arranged on a substrate provided in the installing portion, the thermal head having heating elements arranged along a predetermined arrangement direction;

a conveyor configured to convey the printing medium of the cassette installed in the installing portion along a conveyance path orthogonal to the predetermined arrangement direction;

a first temperature sensor provided, in the installing portion, on a side of the thermal head with respect to the conveyance path;

a second temperature sensor provided in any one of an interior of the cassette case and the installing portion; and a processor configured to:

correct an amount of applying energy to be applied to the heating elements, based on a first temperature detected by the first temperature sensor and a second temperature detected by the second temperature sensor; and apply the corrected amount of the applying energy selectively to the heating elements to cause the heating elements to generate heat, and carry out printing by heating the printing medium with the heat generated, wherein the cassette case includes a head insertion wall portion, the head insertion wall portion forms a head insertion opening which penetrates the cassette case in a direction in which the cassette is installed in the installing portion, the substrate is inserted in the head insertion opening in an installed state in which the cassette is installed in the installing portion, and in the installed state, the first temperature sensor is arranged inside the head insertion opening and the second temperature sensor is arranged inside the cassette case.

2. The printing apparatus according to claim 1, further comprising a heat sink provided on the substrate and configured to release the heat of the heating elements, wherein the first temperature sensor is provided on one of the substrate and the heat sink.

3. The printing apparatus according to claim 1, wherein the cassette case has a facing wall which faces the installing portion in the installed state, and a through hole which is formed in the facing wall, the second temperature sensor is provided in the installing portion at a specific position corresponding to the through hole in the installed state, and the second temperature sensor enters inside of the cassette case through the through hole when the cassette is installed in the installing portion.

4. The printing apparatus according to claim 1, further comprising a connecting section provided in the installing portion, wherein the connecting section is configured to supply electric power to the second temperature sensor when the second temperature sensor is connected thereto, the second temperature sensor is provided in the cassette at a position corresponding to the connecting section in the installed state, and the second temperature sensor is connected to the connecting section in the installed state.

5. The printing apparatus according to claim 3, further comprising an end-mark sensor provided at the specific position and being capable of detecting an end mark that is put on the printing medium, wherein the end-mark sensor enters inside of the cassette case through the through hole when the cassette is installed in the installing portion.

6. The printing apparatus according to claim 1, wherein the head insertion wall portion is formed of an opaque resin material.

* * * * *